US006622434B1

(12) United States Patent
Garrett

(10) Patent No.: US 6,622,434 B1
(45) Date of Patent: Sep. 23, 2003

(54) SAFETY ENCLOSURE SHIELD PANEL SUPPORT SYSTEM

(76) Inventor: Wayne Kenneth Garrett, 4066 No. 30 Side Road, RR#2, Rockwood, Ontario (CA), NOB 2K0

( * ) Notice: Subject to any disclaimer, the term of this patent is extended or adjusted under 35 U.S.C. 154(b) by 0 days.

(21) Appl. No.: 09/576,613

(22) Filed: May 24, 2000

(51) Int. Cl.[7] ..... E04H 3/10

(52) U.S. Cl. ..... 52/6; 52/202; 52/459; 52/475.1; 52/716.8; 52/717.05; 256/24; 472/92; 472/94

(58) Field of Search ..... 52/800.14, 800.12, 52/582.1, 204.7, 204.595, 475.1, 476, 762, 764, 766, 772, 775, 779, 234, 235, 241, 243, 281, 282.1, 459, 6, 202, 716.8, 717.05; 256/24, 25, 31, 73; 472/92, 94

(56) References Cited

U.S. PATENT DOCUMENTS

| | | | | | |
|---|---|---|---|---|---|
| 3,363,390 | A | * | 1/1968 | Crane et al. | 52/716.8 |
| 3,883,120 | A | * | 5/1975 | Tippmann | 256/24 |
| 4,189,459 | A | * | 2/1980 | Jones | 264/255 |
| 4,905,970 | A | | 3/1990 | Holmsten et al. | |
| 5,065,562 | A | * | 11/1991 | Larsen et al. | 52/772 |
| 5,579,624 | A | * | 12/1996 | Aeberhard | 52/733.4 |
| 5,706,625 | A | | 1/1998 | Vallance et al. | |

FOREIGN PATENT DOCUMENTS

| | | |
|---|---|---|
| DE | 851 254 | 10/1952 |

* cited by examiner

*Primary Examiner*—Carl D. Friedman
*Assistant Examiner*—Jennifer I. Thissell
(74) *Attorney, Agent, or Firm*—Elbie R. de Kock

(57) ABSTRACT

A shield panel support, for providing a vertical side edge support for a shield panel, comprises a transparent shield panel support pillar.

21 Claims, 4 Drawing Sheets

SAFETY ENCLOSURE SHIELD PANEL SUPPORT SYSTEM

FIELD OF THE INVENTION

This invention relates to a safety enclosure shield panel support system which is provided, for example, around a playing area such as an ice hockey rink or even the deck area of a single family residence. In particular, it relates to a support for shield panels.

BACKGROUND OF THE INVENTION

Hitherto shield panel supports that are of wood, metal or aluminum have been used.

For example, U.S. Pat. No. 4,905,970 (Holmsden et al), (FIG. 4, numbered item 34) teaches the construction of aluminium, upright shield panel support channels that are H-shaped in cross-section. The shield panel support further comprises an upper tubing section 100, also of aluminum, as shown in FIGS. 3 and 4 of the drawings of the patent. As well, the patent teaches that flexible and compressible gasketing or liners are installed into the supports. The gasketing serves to more firmly secure the shield panel side edges in the supports and to prevent the damage that would be occasioned by direct contact between the panels and metal. The gasketing is further intended to protect the panels from damage by absorbing some of the shock of a collision with the panel by an ice hockey player.

A drawback of the aluminum, metal and wood panel supports is that they impede visibility and present a significant obstruction, for example, to the viewing or televising of an ice hockey game. Consequently, various attempts have been made in the art to maximise visibility. For example, so called "seamless" systems have been developed for ice hockey shield panel support systems to eliminate the shield panel supports and thereby to improve spectator visibility. However, whereas the seamless systems improve visibility, this improvement necessitated significant sacrifices in many other respects. For example, because of the elimination of the vertical shield panel supports, it became necessary to substitute the existing ½" acrylic shield panels of the solid support systems with tempered glass of a substantially greater thickness, namely ⅝". However, although this substitution eliminated the need for the shield panel supports, it did not necessarily result in a much greater benefit, for acrylic is a superior shielding material in many respects with greater transparency characteristics than tempered glass.

Most significantly, the introduction of the seamless system requires substantial modifications to the supporting dasher board systems. To install a seamless system utilizing an existing dasher board system, is not always possible without extensive modification, and often requires replacement of the entire dasher board system. An example of such a seamless system is evident in, for example, U.S. Pat. No. 5,706,625 (Vallance).

Apart from the significant financial outlay required to upgrade or convert existing shield support systems and dasher board systems to a seamless system, it is also readily apparent that the seamless systems are not necessarily "seamless" as implied. Because of the impracticality of using a continuous panel of glass, for example, for an ice hockey rink shielding, the shielding is split into panels as shown in Vallance. Where the panels abut, there is of coarse a vertical "seam" or a "gap" between the panels. As well, top clips are employed in the seamless system to secure the abutting panel top edges in an attempt to provide greater stability, but which also results in an increase in the overall stiffness or rigidity of the seamless system.

The above summary is not intended to be an exhaustive list of the deficiencies in the existing art. Many additional deficiencies will be evident to a person skilled in the art. It is the object of the present invention to provide a shield panel support system that maximizes visibility but without the sacrifices referred to above.

Although the further objects and advantages of the invention will become apparent from the summary of the invention and the description of the preferred embodiment of the invention below, the advantages of the instant invention are the following:

1. It presents a "seamless" effect;
2. It permits the use of acrylic shield panels as opposed to tempered glass shield panels;
3. It eliminates the necessity to use the top edge clips of the seamless systems;
4. The use of gasketing or lining is rendered unnecessary;
5. It provides for the use of light weight shield panels; which decreases conversion and replacement time;
6. Retrofitting into any existing dasher board system is possible without the significant cost outlay to install a seamless system;
7. It eliminates, for example, the necessity of the solid, vertical supports at the gates of an ice hockey rink that has a "seamless" system installed.

SUMMARY OF THE INVENTION

According to the invention there is provided a shield panel support for providing a secure mounting and a vertical side edge support for a shield panel, such as for use around an ice hockey rink and to which specific reference is made in the following description. The ice hockey shield panel support and the ice hockey shield panel is supported on, and removably attached to an ice hockey dasher board system. The ice hockey shield panel support comprises a transparent, vertical shield support pillar. The pillar may comprise a clear, polymer, vertical pillar.

According to one aspect of the invention, the pillar comprises an upper elevation, a lower elevation and a top and bottom end. The pillar may further comprise a longitudinal, intergral shaft and a vertical, stiffening fin. The shaft may comprise a vertical, spinal interface having two opposite side edges, two opposite sides and a vertical, stiffening fin laterally projecting from a first side of the two opposite sides. According to the invention, the two opposite edges of the spinal interface are respectively channelled to snugly receive a vertical, interfacing side edge of the panel. In a further embodiment of the invention, the two opposite side edges of the spinal interface of only the upper elevation of the pillar may be so channelled.

The second side of the two opposite sides of the shaft may define a convex and the laterally projecting, vertical stiffening fin may comprise a tangentially sloped fin having an acute angle at the top end of the pillar and a wide angle at the bottom end of the pillar. According to one aspect of the invention, the said fin may comprise, at the upper elevation of the pillar, the said sloped fin, terminating in a shoulder at a point on the shaft of the pillar between the upper and lower elevation of the pillar. The lower elevation of the pillar may comprise a laterally projecting, vertical fin spanning the pillar from the said shoulder of the sloped fin to the bottom end of the pillar; and which fin is disposed substantially in parallel with the shaft of the pillar.

Further objects and advantages of the invention will become apparent from the description of a preferred embodiment of the invention below.

BRIEF DESCRIPTION OF THE DRAWINGS

The invention is now described with reference to the accompanying drawings, in which.

DETAILED DESCRIPTION OF THE PREFERRED EMBODIMENT

Figure 1:
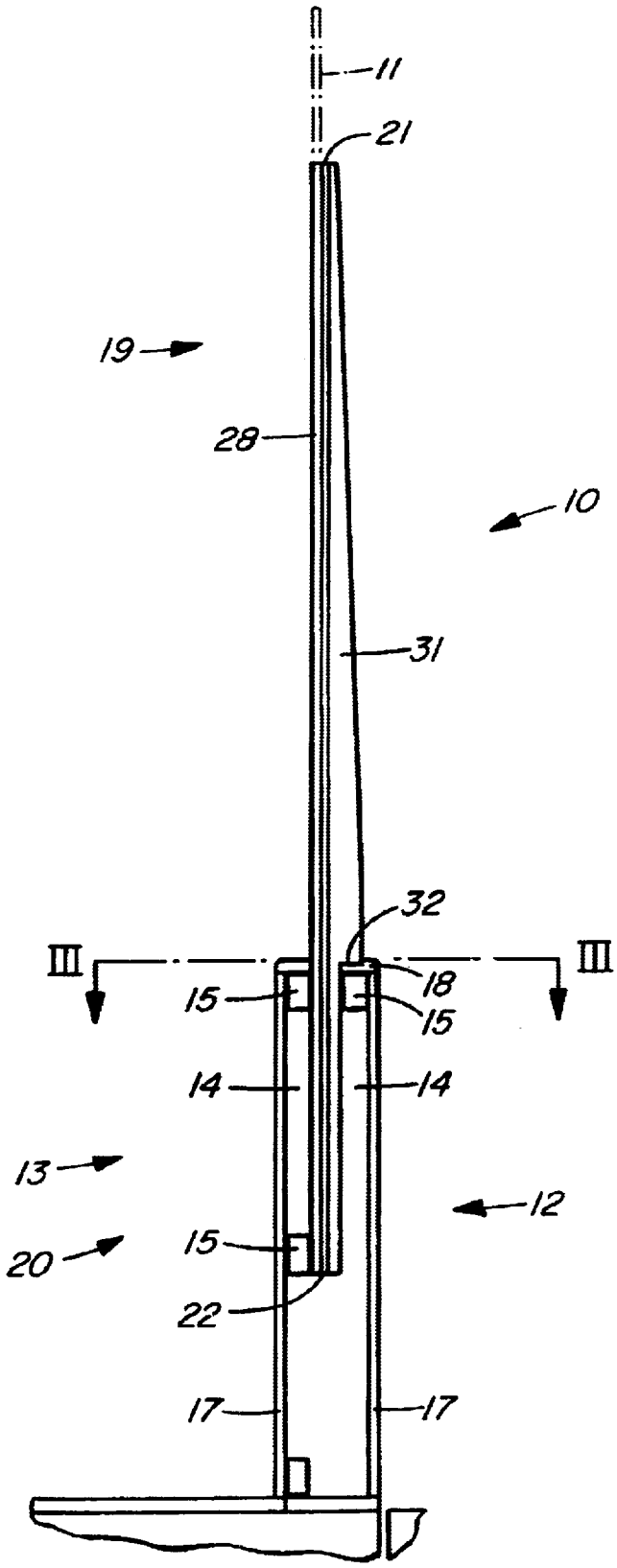
FIG. 1 is a side view of a shield panel support of a dasher board system.

In the drawings, reference numeral 10 generally indicates an ice hockey shield panel support for providing a secure mounting and a side edge support for an ice hockey shield panel 11, which support 10 and shield panel 11 are supported on an ice hockey dasher board system, generally indicated by the numeral 12.

The ice hockey shield panel support 10 comprises a transparent, vertical shield panel support pillar 13, which according to the preferred embodiment of the invention is of a clear polymer.

The dasher board system 12 comprises a plurality of interconnected, vertical 14 and horizontal 15 members to constitute a dasher board frame. The dasher board system 12 further comprises two opposite vertical dasher board side panels 17 and a horizontal dasher board top sill 18. The sill 18 is provided with a groove 9 for receiving the panel support 10.

Figure 3:
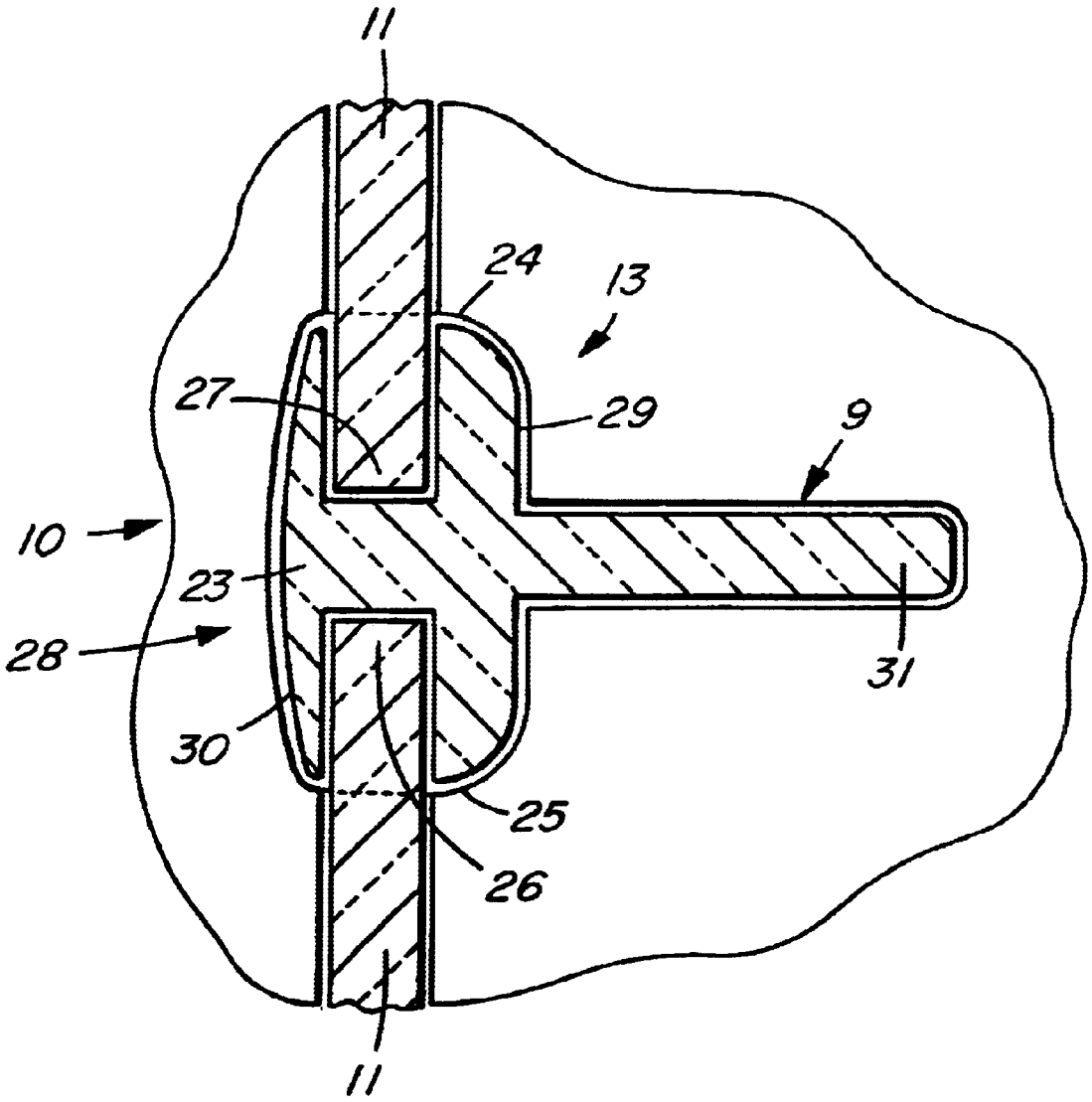
FIG. 3 is a cross-section of the shield panel support of FIG. 1, along line III—III in FIG. 1.
Figure 4:
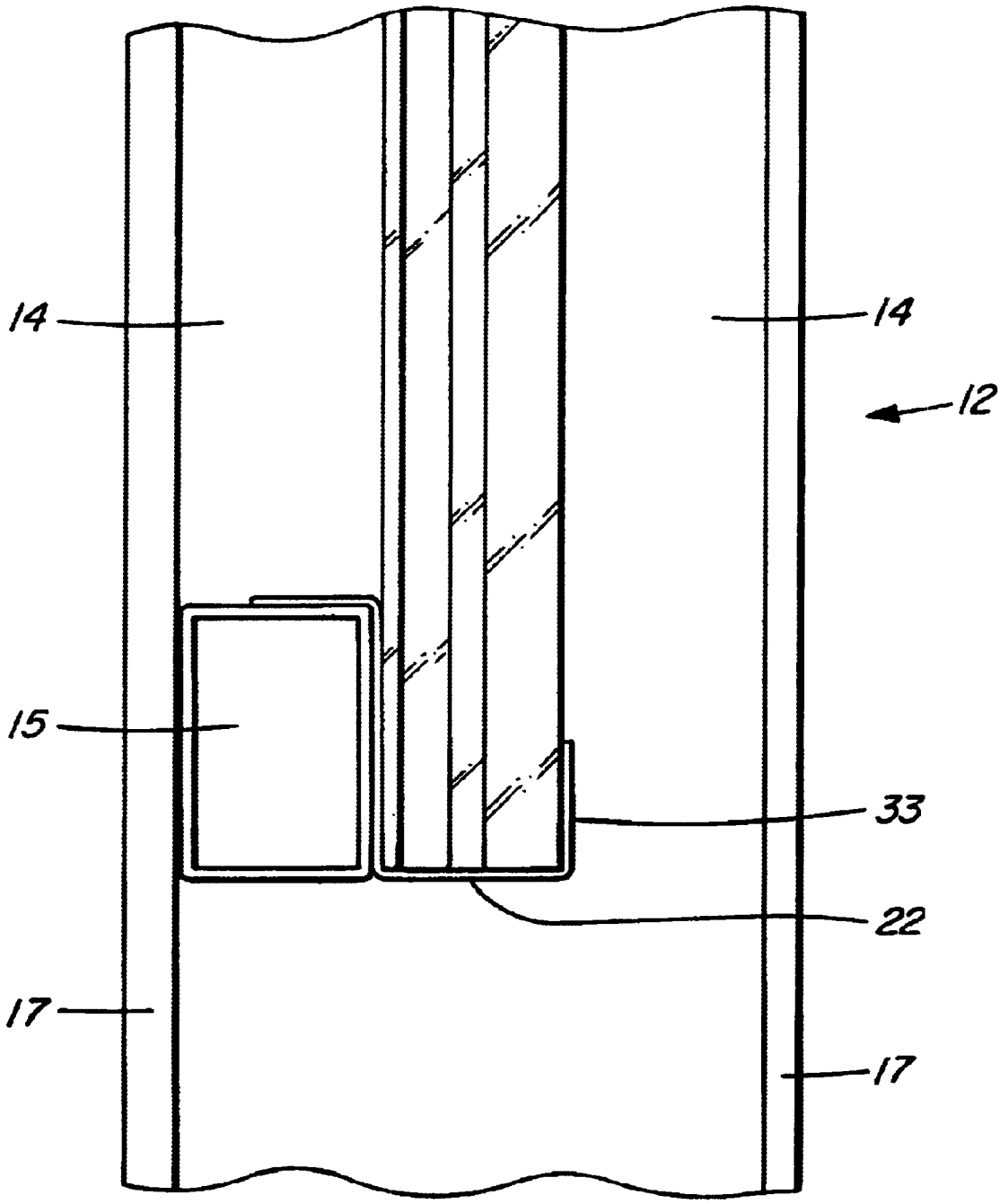
FIG. 4 is a fragmentary side view on an enlarged scale of a part of the shield support of FIG. 1.

The pillar 13 comprises an upper elevation 19 and a lower elevation 20, the top elevation 19 having a top end 21 and the bottom elevation having a bottom end 22. As shown in FIG. 3, the pillar 13 further comprises a shaft 28 being substantially H-shaped and further comprises a spinal interface 23 and two opposite edges 24 and 25. Each edge 24 and 25 is respectively channelled to snugly receive the vertical interfacing edges 26 and 27 of the shield panel 11.

The shaft 28 of the pillar 13 further comprises two opposite sides 29 and 30. The channelled opposite edges 24 and 25 and the opposite sides 29 and 30 span the pillar 13 from the top end 21 to the bottom end 22. The first side 29 comprises a laterally projecting, stiffening fin 31, manufactured as an integral unit with the shaft 28, and spanning the pillar 13 from the top end 21 to the bottom end 22. The second side 30 comprises a convex shaped surface to minimize ice hockey puck deflection.

Figure 2:
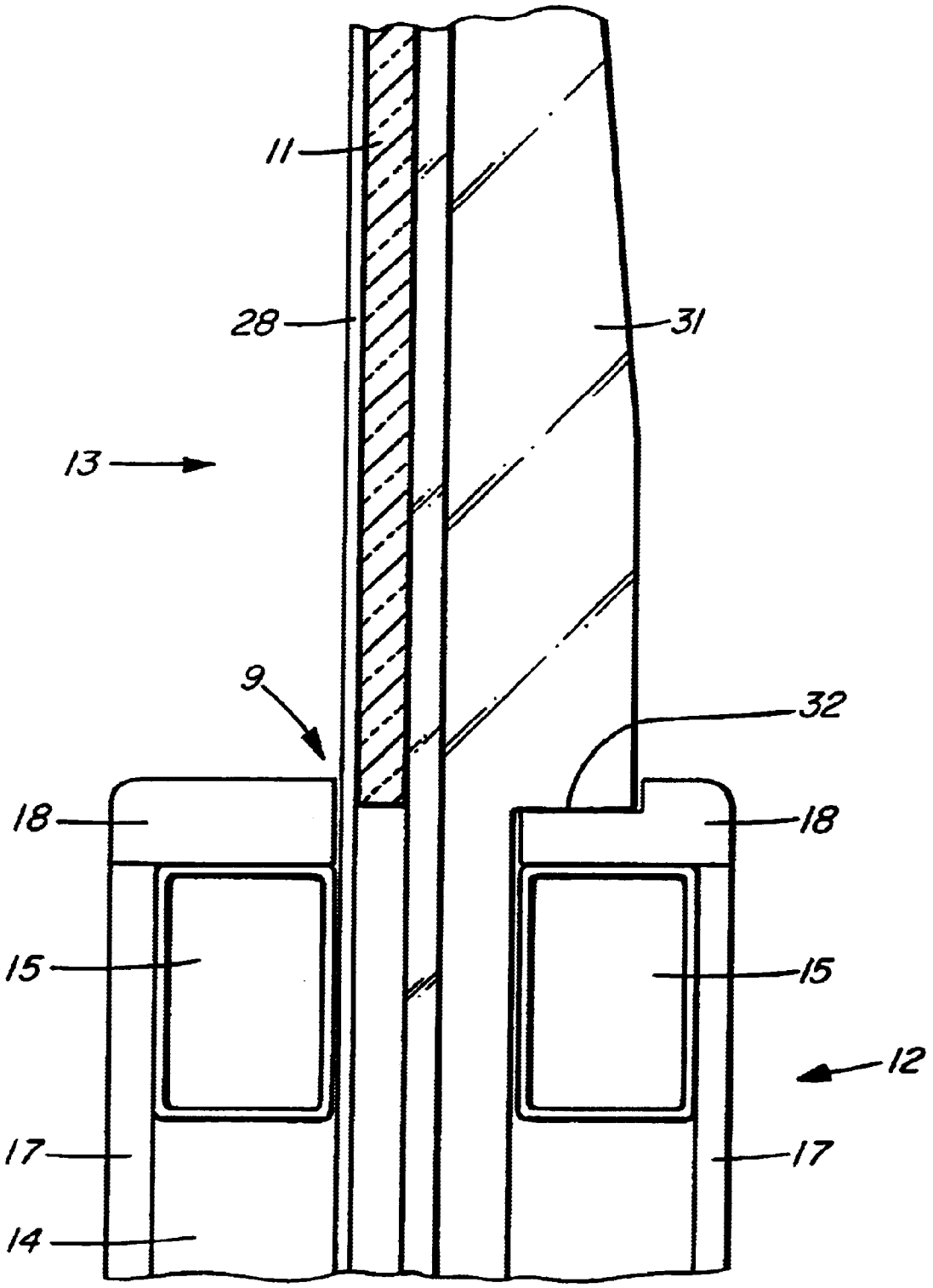
FIG. 2 is a fragmentary side view on an enlarged scale of a part of the shield support of FIG. 1.

The fin 31 is sloped from the top end 21 of the pillar 13 and terminates in shoulder 32 as shown in FIG. 2, at a location on the pillar 13 between the upper 19 and lower 20 elevations of the pillar 13. The fin 31 at the lower elevation 20 of the pillar 13 is disposed substantially in parallel with the shaft 28 of the pillar 13 and spans the lower elevation 20 of the pillar 13 from the shoulder 32 to the bottom end 22 of the pilar 13.

The bottom end 22 of the pillar 13 is removably secured to the horizontal member 15 of the dasher board system 12 by means of a non-continuous support socket 33.

Although a preferred embodiment of the present invention has been shown and described in detail, it should be understood that various changes and modifications may be made therein without departing from the scope of the appended claims.

I claim:

1. A shield panel support for providing a vertical side edge support for a shield panel, the shield panel support being connected to and supported on a support system, and wherein the shield panel support comprises a transparent shield panel support pillar, the support pillar being provided with a pair of channelled opposite edges, each for receiving a vertical edge of a shield panel being supported by the panel support, wherein the support system is an ice hockey dasher board system.

2. The shield panel support of claim 1, wherein the support pillar comprises a clear polymer.

3. The shield panel support of claim 1, the pillar further comprising a longitudinal, integrally manufactured shaft and a vertical stiffening fin.

4. The shield panel support of claim 3, the pillar comprising:

a vertical spinal interface having two opposite sides; and said vertical stiffening fin laterally projecting from one of said two opposite sides.

5. The shield panel support of claim 4, wherein a second side of the said two opposite sides of the shaft substantially defines a convex profile.

6. The shield panel support of claim 4, wherein the said laterally projecting, vertical, stiffening fin comprises a tangentially sloped fin having an acute angle at the top end of the pillar and a wide angle at the bottom end of the pillar.

7. The shield panel support of claim 6, wherein the said laterally projecting, vertical, stiffening fin comprises, at the upper elevation of the pillar, the said tangentially sloped fin, the said sloped fin terminating in a shoulder at a point on the shaft of the pillar between the upper and lower elevations of the pillar.

8. The shield panel support of claim 7 comprising, at the lower elevation of the pillar, a laterally projecting, vertical, secondary stiffening fin disposed substantially in parallel with the shaft of the pillar and spanning the pillar from the said shoulder to the bottom end of the pillar.

9. A shield panel support for providing a vertical side edge support for a shield panel, the shield panel support being connected to and supported on a support system, and wherein the shield panel support comprises a transparent shield panel support pillar, the support pillar being provided with a pair of channelled opposite edges, each for receiving a vertical edge of a shield panel being supported by the panel support, wherein the support system is a deck and a balcony.

10. The shield panel support of claim 9, wherein the support pillar comprises a clear polymer.

11. The shield panel support of claim 9, wherein the pillar further comprises a longitudinal, integrally manufactured shaft and a vertical stiffening fin.

12. The shield panel support of claim 11, the pillar comprising:

a vertical spinal interface having two opposite sides; and said vertical stiffening fin laterally projecting from one of said two opposite sides.

13. The shield panel support of claim 12, wherein a second side of the said two opposite sides of the shaft substantially defines a convex profile.

14. The shield panel support of claim 12, wherein the said laterally projecting, vertical, stiffening fin comprises a tangentially sloped fin having an acute angle at the top end of the pillar and a wide angle at the bottom end of the pillar.

15. The shield panel support of claim 14, wherein the said laterally projecting, vertical, stiffening fin comprises, at the upper elevation of the pillar, the said tangentially sloped fin, the said sloped fin terminating in a shoulder at a point on the shaft of the pillar between the upper and lower elevations of the pillar.

16. The shield panel support of claim 15, comprising at the lower elevation of the pillar, a laterally projecting, vertical, secondary stiffening fin disposed substantially in parallel with the shaft of the pillar and spanning the pillar from the said shoulder to the bottom end of the pillar.

17. A shield panel support for providing a vertical side edge support for a shield panel, the shield panel support being connected to and supported on a support system, wherein the shield panel support comprises a transparent shield panel support pillar and wherein the support system is an ice hockey dasher board system.

18. The shield panel support of claim 17, wherein the support pillar comprises a clear polymer.

19. The shield panel support of claim 17, wherein the pillar further comprises a longitudinal, integrally manufactured shaft and a vertical stiffening fin.

20. The shield panel support of claim 19, the pillar comprising:

a vertical spinal interface having two opposite sides; and said vertical stiffening fin laterally projecting from one of said two opposite sides.

21. The shield panel support of claim 20, wherein a second side of the said two opposite sides of the shaft substantially defines a convex profile.

* * * * *